United States Patent [19]

Shapiro

[11] Patent Number: 5,067,939

[45] Date of Patent: Nov. 26, 1991

[54] CONVEYORLESS CLARIFIER

[75] Inventor: Ascher H. Shapiro, Jamaica Plain, Mass.

[73] Assignee: Bird Machine Company, South Walpole, Mass.

[21] Appl. No.: 496,906

[22] Filed: Mar. 21, 1990

[51] Int. Cl.[5] ..... B04B 1/20

[52] U.S. Cl. ..... 494/53; 210/295; 494/45

[58] Field of Search ..... 494/52, 53, 54, 36, 494/27, 28, 29, 45, 23, 56, 57, 58, 60; 210/781, 782, 365, 366

[56] References Cited

U.S. PATENT DOCUMENTS

| | | | |
|---|---|---|---|
| 631,680 | 8/1899 | Staahlgren | 494/45 |
| 2,593,278 | 4/1952 | Edwards . | |
| 3,423,016 | 1/1969 | Heckmann . | |
| 3,814,307 | 6/1974 | Hengstebeck . | |
| 4,027,820 | 6/1977 | Kulker . | |
| 4,037,781 | 7/1977 | High . | |
| 4,240,578 | 12/1980 | Jackson | 494/53 X |
| 4,303,192 | 12/1981 | Katsume | 494/53 X |
| 4,339,072 | 7/1982 | Hiller | 494/52 X |
| 4,530,691 | 7/1985 | Brown | 494/45 |
| 4,642,186 | 2/1987 | Nakamura | 210/295 X |
| 4,714,456 | 12/1987 | Bender et al. | 494/36 |

FOREIGN PATENT DOCUMENTS

| | | | |
|---|---|---|---|
| 439301 | 1/1975 | U.S.S.R. . | |
| 614803 | 7/1978 | U.S.S.R. . | |
| 747532 | 7/1980 | U.S.S.R. . | |
| 891570 | 12/1981 | U.S.S.R. . | |
| 2182869 | 5/1987 | United Kingdom | 494/53 |

*Primary Examiner*—Daniel M. Yasich

*Attorney, Agent, or Firm*—Choate, Hall & Stewart

[57] ABSTRACT

A rotating bowl decanter centrifuge including a clarifier section and a beach section for separating a lighter phase from a heavier phase. The beach section includes a conveyor for conveying the heavier phase toward the exterior of the centrifuge. The centrifuge is without a conveyor in the effluent discharge end of the clarifier section. In a preferred embodiment, the clarifier section has an outward incline angle so that the clarifier wall bends away from the bowl's rotational axis. The beach section includes an inwardly inclined outer wall which bends towards the rotational axis of the bowl. It is preferred that the outward incline angle in the clarifier section be on the order of 5° or less.

23 Claims, 4 Drawing Sheets

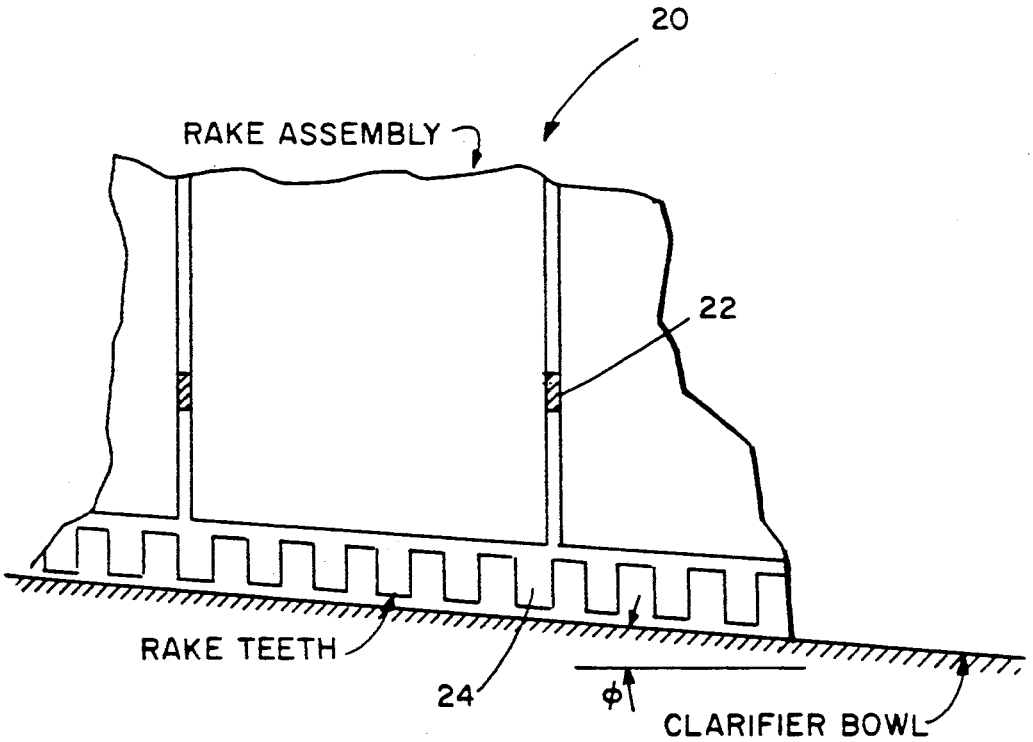
FIG. 2
FIG. 3
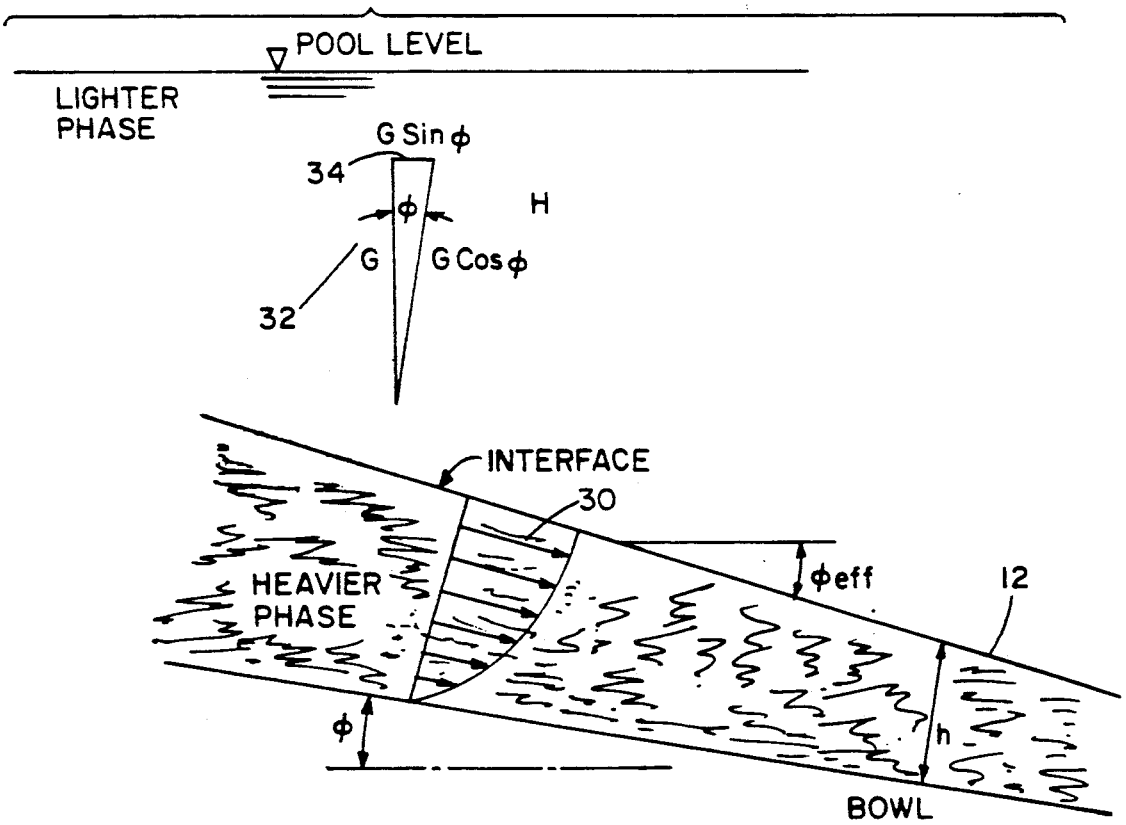

CONVEYORLESS CLARIFIER

BACKGROUND OF THE INVENTION

This invention relates to a rotating bowl decanter centrifuge.

In the process of separating heavier phase material from lighter phase material, a solid from a liquid for instance, a rotating bowl decanter centrifuge is often utilized. The centrifuge has a bowl cavity which includes a clarifier section to separate the materials by reason of density differences under the action of centrifugal force. The heavier phase materials are deposited radially on the bowl wall, and move longitudinally along that wall to a beach section. The bowl wall conventionally has a zero incline angle, i.e., the wall is the same distance from the bowl axis throughout the clarifier section.

Conventionally, both the clarifier and beach sections include a conveyance device utilized to transport the heavier phase material from the clarifier section to the beach section, and thence toward the heavier-phase discharge end of the centrifuge. Often these conveyance devices comprise one or more co-axial rotating helical conveyers operating at a speed differential with respect to the rotating bowl. That segment of the conveyor situated in the clarifier section acts to move the sedimented heavier phase toward the beach.

The conveyor serves several purposes in the clarifier section. It acts to move the sedimented heavier phase toward the beach. In so doing, it also raises the level of the heavier phase interface in the centrifugal force field, and thereby reduces the radial distance by which the heavier phase has to be "lifted" by the beach. The conveyer also helps to impart rotational velocity to the feed, thus promoting the centrifugal force field necessary for a high rate of sedimentation.

SUMMARY OF THE INVENTION

In a first aspect, the invention features a clarifier section without a conveyor at the effluent discharge end and a bowl wall in this section having a geometric outward incline angle, $\Phi$, sufficient to cause the heavier phase to be forced by the centrifugal field to flow "downhill" along the bowl wall toward the beach section. Removing the conveyor from this portion of the clarifier section, but keeping it at the beach end, has important advantages. First, much of the secondary flow (and associated problems) caused by the conveyor in the clarifier is eliminated. This results in an increased sedimentation capacity of the heavier phase, increased clarity of the lighter phase at the effluent discharge end, and greater recovery of heavier phase. Second, it allows the beach conveyor to operate at a greater differential speed relative to the bowl (thus increasing throughput in the beach section) than would be possible if the conveyor extended throughout the clarifier section, because in the clarifier a greater differential speed would produce undesirable mixing currents near the effluent discharge end thereby reducing clarity of the lighter phase and recovery of the heavier phase. Because the beach conveyor can handle greater throughput, the clarifier can be designed to achieve more sedimentation. Third, most of the benefits associated with having a conveyor in the clarifier section are maintained. Lastly, the machine is simplified, and its cost reduced.

In a second aspect, the invention features a clarifier section wherein the bowl wall of the clarifier has an outward incline angle, $\Phi$, of less than 5°, which is sufficient to cause the heavier phase to be forced by the centrifugal field to flow "downhill" along the bowl wall to the beach section, but not so large as to increase unduly the radial distance by which the heavier phase has to be lifted in the beach section.

In a third aspect, the invention features provision of one or more rakes in the conveyorless portion of the clarifier. The rakes have elements extending into the heavier phase for promoting fluidity of the heavier phase.

In a fourth aspect, the invention features a centrifuge configured so that, in operation, the interface between the heavier and lighter phases is inclined by an angle, $\Phi_{eff}$, greater than 0° to promote downhill movement of the heavier phase toward the beach section, even with no conveyor in part or all of the clarifier.

In preferred embodiments the clarifier has a conveyor in the last fifty percent, and preferably, the last thirty percent of the clarifier length adjacent the beach, or is fully without a conveyor. The geometric inclined angle is less than 1° and can include 0° provided there is an effective incline, $\Phi_{eff}$, at the interface between the heavier and lighter phases, and the heavier phase maintains fluidity, or does not compact on the clarifier wall, or is prevented from so doing by means of a rake.

Other features and advantages of the invention will be apparent from the following description of a preferred embodiment and from the claims.

DESCRIPTION OF THE PREFERRED EMBODIMENT

FIG. 2 is a diagrammatic view of the rake assembly of the preferred embodiment.

FIG. 3 is a representation of a typical flow profile in the clarifier section of the preferred embodiment when the clarifier includes an incline angle, $\Phi$.

Figure 1:
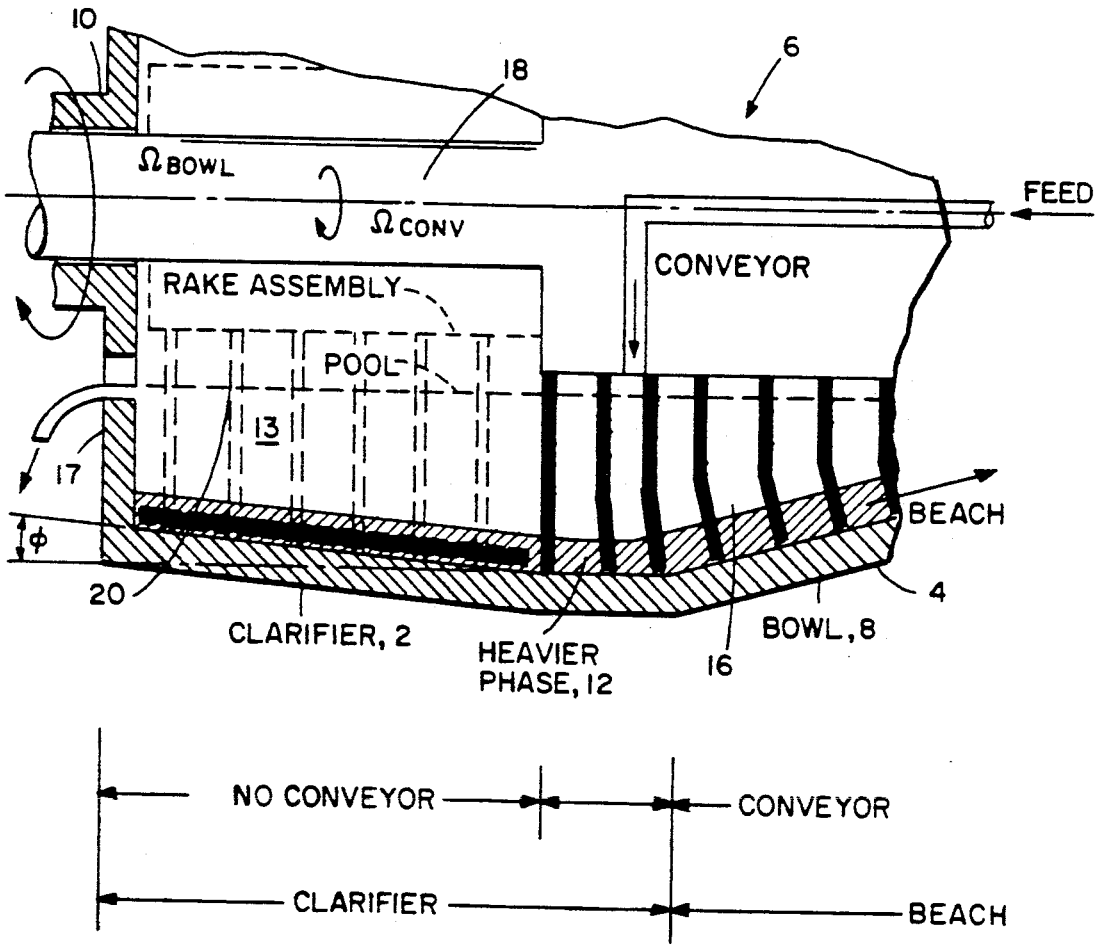
FIG. 1 is a diagrammatic sectional view of a preferred embodiment of the invention.

FIG. 1 shows a rotating bowl decanter centrifuge 6 having a clarifier section 2 and a beach section 4. A bowl 8 turns at a fixed rotational velocity, $\Omega_{bowl}$ measured, for example, in revolutions per minute. The rotating action of the bowl 8, accomplished from the rotation of an axial outer shaft 10, causes a centrifugal separation by density of a heavier phase 12 from a lighter phase 13, with the heavier phase 12 forced to the perimeter of the inner bowl surface. The bowl surface includes an outer wall inwardly inclined towards the rotational axis of the bowl and an outward incline angle, $\Phi$ extending away from the bowl's rotational axis. A slight geometric incline angle, $\Phi$, of 1° or less in that part of the clarifier not containing a conveyor causes the centrifugal field to move the heavier phase 12 toward the beach section 4. The 1° incline angle, $\Phi$, is about optimal for normal operating conditions. A larger angle provides a greater force for moving the heavier phase toward the beach section, but it also increases the distance that the heavier phase must be lifted in the beach section. Because the conveyor in the beach section can only lift a specified flow rate of heavier phase material at a certain angle because of force considerations, an increased beach height differential results in an increased beach length. Therefore, an incline angle of less than 5°, more often less than 3°, in the clarifier section is preferred. With certain heavier phase materials it may be as little as 0°.

A helical screw conveyor 16 is operated off an axial inner shaft 18 having rotational velocity, $\Omega_{conveyor}$, measured for example, in revolutions per minute, which is at a slight speed differential from the bowl 8 rotational velocity. The conveyor 16 originates at a point downstream of the effluent discharge end 17 and operates in approximately 30 to 50 percent of the clarifier section. Depending on the heavier phase material, no conveyor may be necessary in the clarifier section. The conveyor 16 transports the heavier phase 12 toward the heavier-phase discharge part of the bowl 8. A rake assembly 20 in that part of the clarifier section 2 not containing a conveyor acts to prevent the solidification and accumulation of the heavier phase 12, and thereby allows continuous operation of the centrifuge 6 as the heavier phase 12 moves continuously toward the beach 4.

FIG. 2 is a more detailed drawing of one type of the rake assembly 20. In this embodiment, support arms 22 attached at one end to the axial conveyor shaft 18 (FIG. 1) and attached at the other end to rake teeth 24 rotate at the rotational velocity of the screw conveyor 16, $\Omega_{conveyor}$. The scraping action of the rake assembly 20 on the bowl wall maintains fluidity in the heavier phase 12 allowing it to move readily toward the beach and thereby assuring proper operation of the centrifuge 6. The rake assembly 20 is designed to cause minimal flow disturbances in the clarifier, and therefore it does not create secondary flow problems associated with a conventional conveyor that extends the whole length of the clarifier.

FIG. 3 illustrates a flow profile 30 of a clarifier section 2 having an incline angle, $\Phi$. The vector component G sin $\Phi_{eff}$ of the centrifugal force (G) 32 applied to the heavier phase 12 induces motion in the heavier phase 12 from the clarifier section 2 to the beach section 4. The effective incline angle, $\Phi_{eff}$, is defined as the angle of the upper surface of the heavier phase in relation to the bowl axis, and may be greater or less than the geometric angle, $\Phi$. When the latter is very small, the location of maximum thickness of the heavier phase 12 occurs at the effluent discharge end and decreases gradually along the clarifier length. Therefore, a component 34 of the centrifugal force 32 acts along the interface between the lighter phase and the heavier phase 12 to force the heavier phase 12 to move toward the beach section 4.

Figure 5:
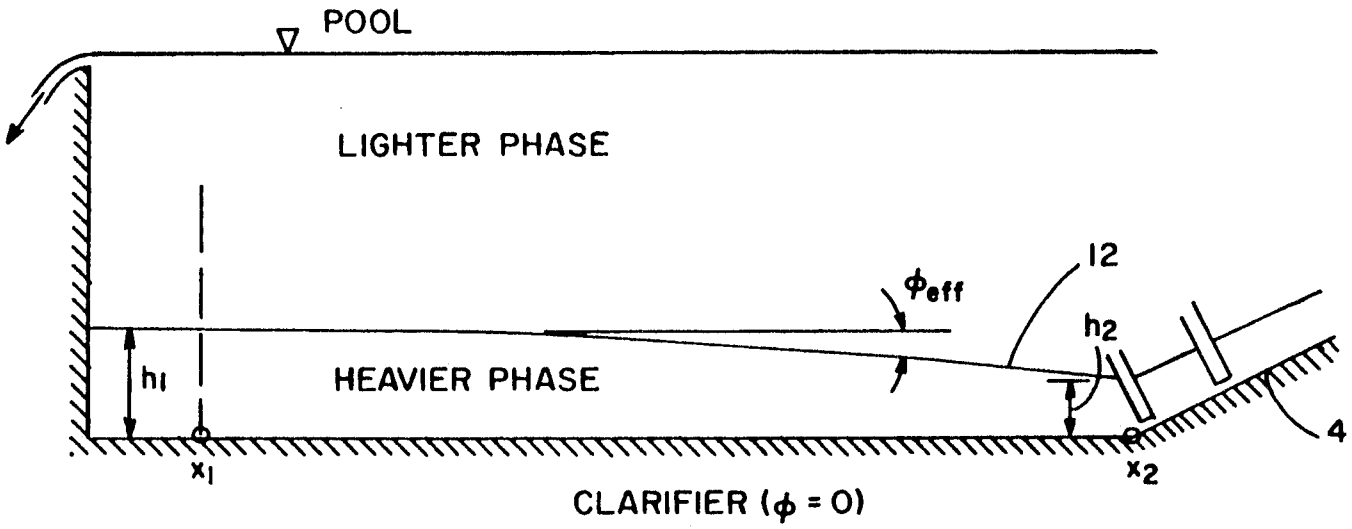
FIG. 5 is a heavier phase profile for a 0° incline angle, $\Phi=0$, in a clarifier without a conveyor.

FIG. 5 demonstrates schematically a heavier phase 12 thickness profile for a 0° incline angle, $\Phi=0$. Because of the natural tendency for the surface of the heavier phase 12 to position itself in an effective incline angle, $\Phi_{eff}$, relative to the bowl axis, the heavier phase 12 is transported toward the beach section 4 by reason of the centrifugal force acting upon it.

An illustrative set of calculations shows that with practical operating conditions a conveyorless clarifier may operate without building up excessive thicknesses of heavier phase material. The illustrative example refers to a machine for municipal sludge with dimensions and operating conditions as follows, and which has no conveyor at all in the clarifier section:

Bowl Diameter: 30 inches
Length of Clarifier: 66 inches
Bowl speed: 2450 rev/min
Feed rate: 290 gal/min
Percent solids in feed: 1%
Percent solids in sedimented sludge: 15%
Kinematic viscosity of Sedimented sludge: 1 $cm^2$/sec
Specific gravity of Sedimented sludge: 1.01

Figure 4:
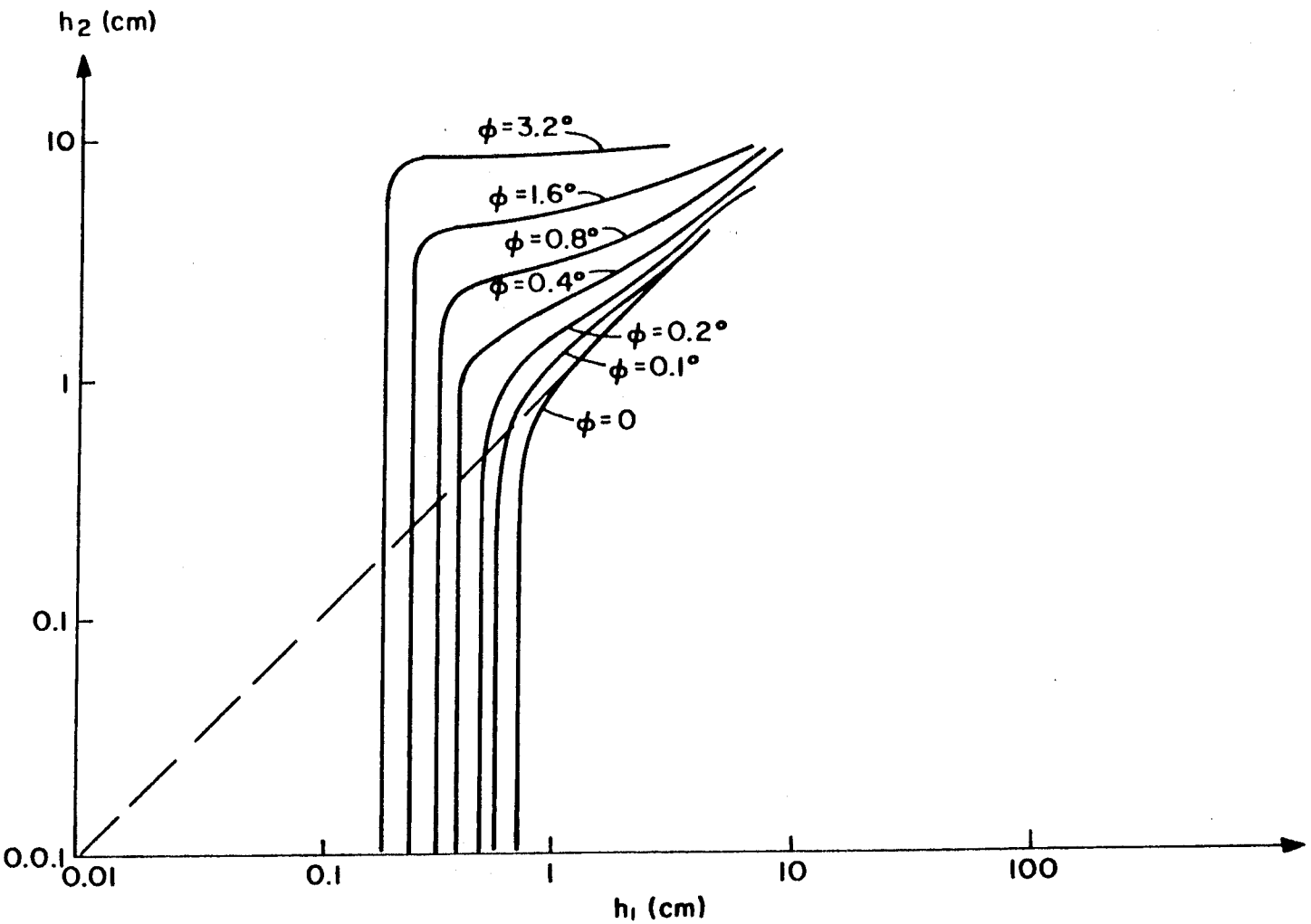
FIG. 4 is a graph depicting the thickness, $h_2$, of the heavier phase at a point near the beginning of the beach section where the conveyor originates versus the thickness, $h_1$, of the heavier phase at a point near the effluent end of the clarifier section for particular conditions later described, and for varying incline angles, $\Phi$.

Heavier phase thickness profiles in the clarifier, corresponding to the stated conditions, have been determined for incline angles, $\Phi$, from 0° to 3.2°. FIG. 4 is a graph of the heavier phase thickness, $h_2$, at the beginning of the beach section versus the heavier phase thickness, $h_1$, at a location in the clarifier near the effluent end. Specific numerical results are also shown in Table 1. The results demonstrate that a small incline angle, $\Phi$, of the order of 1° or less is sufficient for operation with thicknesses of the heavier phase that lie in an acceptable and convenient operating range. They demonstrate also that an incline angle of 0° is feasible as well; for instance, with a thickness of 1 cm. at the beginning of the beach section, the thickness near the efficient end is 1.05 cm, which is only slightly greater.

TABLE 1

| | Concentrated Sedimentation Table shows $h_1$ (cm.) | | | |
|---|---|---|---|---|
| | Values of $h_2$ (cm.) | | | |
| (DEG) | 0.1 | 0.3 | 1 | 3 |
| 0. | 0.68 | 0.68 | 1.05 | 3.0 |
| 0.1 | 0.55 | 0.55 | 0.80 | 2.7 |
| 0.2 | 0.48 | 0.48 | 0.60 | 2.5 |
| 0.4 | 0.37 | 0.37 | 0.38 | 1.9 |
| 0.8 | 0.30 | 0.30 | 0.30 | 0.92 |
| 1.6 | 0.23 | 0.23 | 0.23 | 0.24 |
| 3.2 | 0.18 | 0.18 | 0.18 | 0.18 |
| 6.4 | 0.15 | 0.15 | 0.15 | 0.15 |

Other embodiments of the invention are within the following claims.

What is claimed is:

1. A rotating bowl decanter centrifuge for continuous operation for separating a lighter phase from a heavier phase, said centrifuge comprising a clarifier section in which the heavier phase is separated from the lighter phase, said clarifier section having an effluent discharge end at which said lighter phase is discharged and an outer wall on which said heavier phase is deposited, a beach section downstream of said clarifier section, said beach section receiving the heavier phase from said clarifier and having an inwardly inclined outer wall as well as a conveyor for conveying the heavier phase toward the heavier phase discharge end of the centrifuge, said clarifier section having a first portion without the conveyor from said effluent discharge end part way to said beach section, and having a second portion with the conveyor in the remaining portion of the clarifier adjacent to the beach section, and said outer wall of said clarifier having in the part without the conveyor an outward incline angle, $\Phi$, sufficient to cause the heavier phase to be moved by centrifugal force along said wall to said beach section.

2. The centrifuge of claim 1 wherein the clarifier section has the conveyor in the last fifty percent of clarifier length.

3. The centrifuge of claim 1 wherein the clarifier section has the conveyor in the last thirty percent of clarifier length.

4. A rotating bowl decanter centrifuge for continuous operation for separating a lighter phase from a heavier phase, said centrifuge comprising a clarifier section in which the heavier phase is separated from the lighter phase, said clarifier section having an effluent discharge end at which said lighter phase is discharged and an outer wall on which said heavier phase is deposited, a beach section downstream of said clarifier section, said beach section receiving the heavier phase from said clarifier and having an inwardly inclined outer wall as well as a conveyor for conveying the heavier phase toward the heavier phase discharge end of the centrifuge, said clarifier section having a portion without a conveyor from said effluent discharge end at least part way to said beach section, said outer wall of said clarifier having in the portion without the conveyor an outward incline angle, $\Phi$, less than 5°.

5. The centrifuge of claim 4 wherein the incline angle, $\Phi$, is less than 3°.

6. The centrifuge of claim 5 wherein the clarifier section has the conveyor in the last fifty percent of clarifier length.

7. The centrifuge of claim 5 wherein the clarifier section has the conveyor in the last thirty percent of clarifier length.

8. The centrifuge of claim 5 wherein the clarifier section is fully without the conveyor.

9. The centrifuge of claim 5 wherein the incline angle, $\Phi$, is less than 1°.

10. The centrifuge of claim 5 wherein the incline angle, $\Phi$, is 0°.

11. The centrifuge of any one of claims 1–10 wherein the conveyorless portion of the clarifier has a rake with elements extending into the heavier phase for promoting fluidity of the heavier phase.

12. The centrifuge of claim 5 wherein said clarifier section, in operation, creates an interface between the heavier and lighter phases which is outwardly inclined by an angle, $\Phi_{eff}$, greater than 0° to promote movement of the heavier phase toward the beach section.

13. The clarifier of claim 12 wherein said incline angle, $\Phi$, of said outer wall of said clarifier section is 0°.

14. A rotating bowl decanter centrifuge for continuous operation for separating a lighter phase from a heavier phase, said centrifuge comprising a clarifier section in which the heavier phase is separated from the lighter phase, said clarifier section having an effluent discharge end at which said lighter phase is discharged and an outer wall on which said heavier phase is deposited, a beach section downstream of said clarifier section, said beach section receiving the heavier phase from said clarifier and having an inwardly inclined outer wall as well as a conveyor for conveying the heavier phase toward the heavier phase discharge end of the centrifuge, said clarifier section having a portion without the conveyor from said effluent discharge end at least part way to said beach section, said conveyorless portion of said clarifier having one or more rakes with elements extending into the heavier phase for promoting fluidity of the heavier phase.

15. The centrifuge of claim 14 wherein the clarifier has the conveyor in the last fifty percent of clarifier length.

16. The centrifuge of claim 14 wherein the clarifier has the conveyor in the last thirty percent of clarifier length.

17. The centrifuge of claim 14 wherein the clarifier is fully without the conveyor.

18. The centrifuge of claim 14 wherein said clarifier section, in operation, creates an interface between the heavier and lighter phases which is outwardly inclined by an angle, $\Phi_{eff}$, greater than 0° to promote movement of the heavier phase toward the beach section.

19. The centrifuge of claim 14 wherein said elements are attached to an axial shaft and rotated at the conveyor rotational velocity.

20. A rotating bowl decanter centrifuge for continuous operation for separating a lighter phase from a heavier phase, said centrifuge comprising a clarifier section in which the heavier phase is separated from the lighter phase, said clarifier section having an effluent discharge end at which said lighter phase is discharged and an outer wall on which said heavier phase is deposited, a beach section downstream of said clarifier section, said beach section receiving the heavier phase from said clarifier and having an inwardly inclined outer wall as well as a conveyor for conveying the heavier phase toward the heavier phase discharge end of the centrifuge, said clarifier section having a portion without the conveyor from said effluent discharge end at least part way to said beach section, and said centrifuge being configured to create an interface between the heavier and lighter phases that is outwardly inclined by an angle, $\Phi_{eff}$, greater than 0° to promote movement of the heavier phase toward the beach section.

21. The centrifuge of claim 20 wherein the clarifier has the conveyor in the last fifty percent of clarifier length.

22. The centrifuge of claim 20 wherein the clarifier has the conveyor in the last thirty percent of clarifier length.

23. The centrifuge of claim 20 wherein the clarifier is fully without the conveyor.

* * * * *